United States Patent [19]

Kurosaki

[11] 4,186,644

[45] Feb. 5, 1980

[54] FOOT PEDAL ASSEMBLY FOR DRUMS

[75] Inventor: Makoto Kurosaki, Hamamatsu, Japan

[73] Assignee: Nippon Gakki Seizo Kabushiki Kaisha, Japan

[21] Appl. No.: 815,655

[22] Filed: Jul. 14, 1977

[30] Foreign Application Priority Data

Jul. 16, 1976 [JP] Japan ..... 51/94548[U]

[51] Int. Cl.[2] ..... G10D 13/02; G10D 13/00

[52] U.S. Cl. ..... 84/422 R; 74/512

[58] Field of Search ..... 84/422 R; 74/96, 98, 74/237, 231 C, 512, 422 R

[56] References Cited

U.S. PATENT DOCUMENTS

| | | | |
|---|---|---|---|
| 3,498,684 | 3/1970 | Hallaman | 74/237 |
| 3,558,390 | 1/1971 | Habegger | 74/237 |
| 3,621,727 | 11/1971 | Cicognani | 74/237 |
| 3,797,356 | 3/1974 | Duffy | 84/422 |

*Primary Examiner*—L. T. Hix
*Assistant Examiner*—S. D. Schreyer
*Attorney, Agent, or Firm*—Ostrolenk, Faber, Gerb & Soffen

[57] ABSTRACT

A rocker cam for holding a beater head and a resilient belt or strap for operationally connecting the rocker cam to an inclined foot pedal are coupled to each other via meshing engagement by cooperating indentations formed on mating surfaces of the two members and tensile strength of the belt or strap is remarkably enhanced by fortifying members such as steel wires or glass fibers longitudinally embedded in the belt or strap. Stress concentration on a set screw for fixing the belt or strap to the rocker cam can be avoided, permanent strain of the belt or strap after long use is divided into mutually incumulative small fragments and reliable coupling between the belt or strap and the rocker cam assures fair conversion of foot action into beater head movement without undesirable metallic noises.

1 Claim, 7 Drawing Figures

FOOT PEDAL ASSEMBLY FOR DRUMS

BACKGROUND OF THE INVENTION

The present invention relates to a foot pedal assembly for drums, and more particularly relates to a foot assembly of the type in which movement of a stepped-on foot pedal is transmitted to a rocker cam via a suitable connector to cause beating motion of a beater head carried by the rocker cam.

One example of such a foot pedal assembly is disclosed in U.S. Pat. No. 2,800,828 in which a metallic link chain is used as the connector between the rocker cam and the foot pedal. The trouble with this metallic link chain connection is that movement of the link chain is inevitablly accompanied by undesirable metallic noise which fatally degrades the acoustic effect of musical instruments for which the foot pedal assembly is used. This influence by the metallic noises is not negligible especially when the foot pedal is stepped on in succession.

Another example of the above-described type foot pedal assembly uses a rigid strap such as a thin steel strap as the connector between the rocker cam and the foot pedal. In this case, the upper end portion of the rigid strap can hardly be entrained about the periphery of the rocker cam due to its poor resiliency. In other words, the rigid strap is in contact with the rocker cam at the fixed point thereof to the rocker cam only and most of the remaining portion of the rigid strap does not come in contact with the periphery of the rocker cam when the foot pedal is stepped on and the rigid strap is pulled down thereby. Therefore, the pulling force by the rigid strap cannot be fairly converted into torque for causing axial rotation of the rocker cam, i.e. swing movement of the beater head for beating the drum head. For this reason, it is very difficult for players to correctly preset the step-on force to be imposed upon the foot pedal. In addition, although it is not so serious as in the case of the foot pedal assembly using the metallic link chain, this foot pedal assembly cannot be completely free from the trouble of metallic noises.

For the purpose of avoiding metallic noise and facilitating settlement of correct step-on force to be imposed upon the foot pedal, a foot pedal assembly using a flexible belt or strap as the connector between the rocker cam and the foot pedal is already proposed. One example of such a foot pedal assembly is disclosed in U.S. Pat. No. 3,030,847. In this case, the belt or strap is made of a resiliently pliable material such as leather or rubber. Using a non-metallic connector, this foot pedal assembly is quite free from metallic noise trouble. However, the conventional foot pedal assembly of this type is inevitably accompanied with different kinds of drawbacks. As the belt or strap is fixed to a point on the periphery of the rocker cam by a set screw and the remaining portion of the belt or strap comes into snug but smooth surface contact with the periphery of the rocker cam when the foot pedal is stepped on, stress concentration occurs on the set screw which accelerates quick breakage of the set screw. Development of permanent strain on the belt or strap due to the relatively small tensile strength of the resilient material connects to unfair following of the beater head motion to the step-on motion applied to the foot pedal. In addition, the smooth contact of the belt or strap with the periphery of the rocker cam makes it rather difficult to ideally convert the substantially linear movement of the belt or strap into corresponding turning motion of the beater head to beat drum heads.

SUMMARY OF THE INVENTION

It is a principal object of the present invention to provide a foot pedal assembly for drums which is quite free from the metallic noise trouble.

It is another object of the present invention to provide a foot pedal assembly for drums which successfully slashes stress concentration upon the set screw for fixing the belt or strap to the periphery of the rocker cam.

It is the other object of the present invention to provide a foot pedal assembly for drums which assures easy setting of the step-on force to be applied to the foot pedal even when relatively large permanent strain is developed on the belt or strap after long use.

It is still another object of the present invention to provide a foot pedal assembly for drums on which the substantially linear movement of the belt or strap can be ideally converted into corresponding turning movement of the beater head to beat drum heads.

In accordance with the present invention, indentations are formed on the periphery of the rocker cam while running in the axial direction of the rocker cam. These indentations define raised teeth that also run axially of the cam. In accordance with this, indentations are also formed on the belt or strap in the area to be entrained about the rocker cam when the foot pedal is stepped on. The indentations run in the width direction of the belt or strap and are meshing engageable with the raised teeth that are formed on the rocker cam. Suitable fortifying members such as steel wires or glass fibers may advantageously be embedded in the belt or strap while running in longitudinal direction of the belt or strap in order to enhance tensile strength of the belt or strap.

DESCRIPTION OF THE PREFERRED EMBODIMENT

Figure 1A:
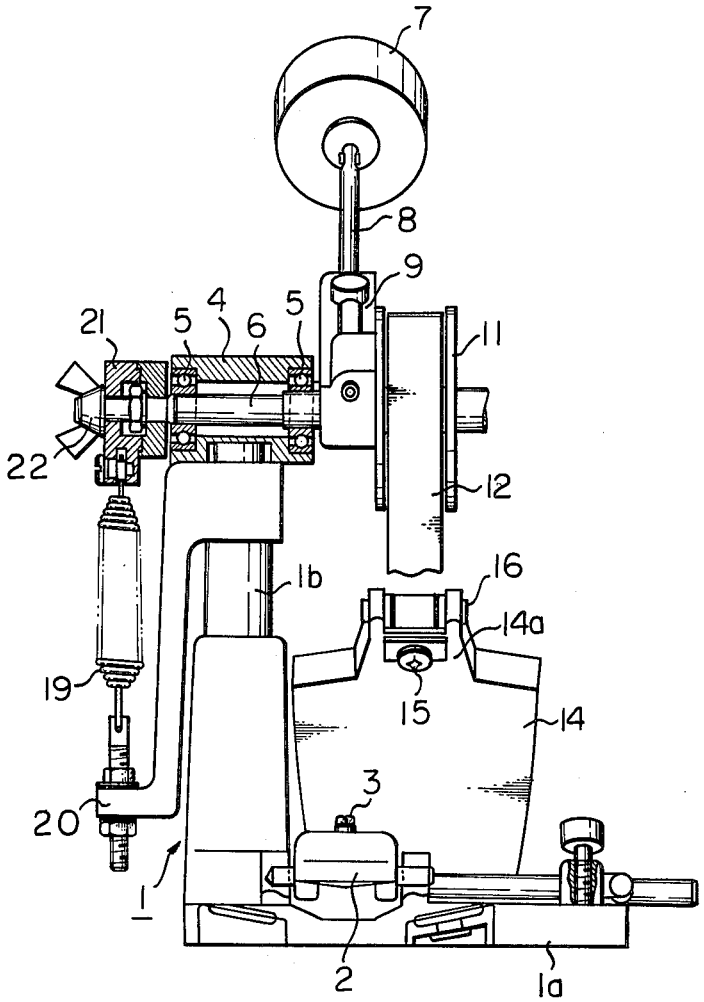
Fig. 1A PRIOR ART
FIG. 1A is a partly sectional front view of an example of the conventional foot pedal assembly for drums.
Figure 1B:
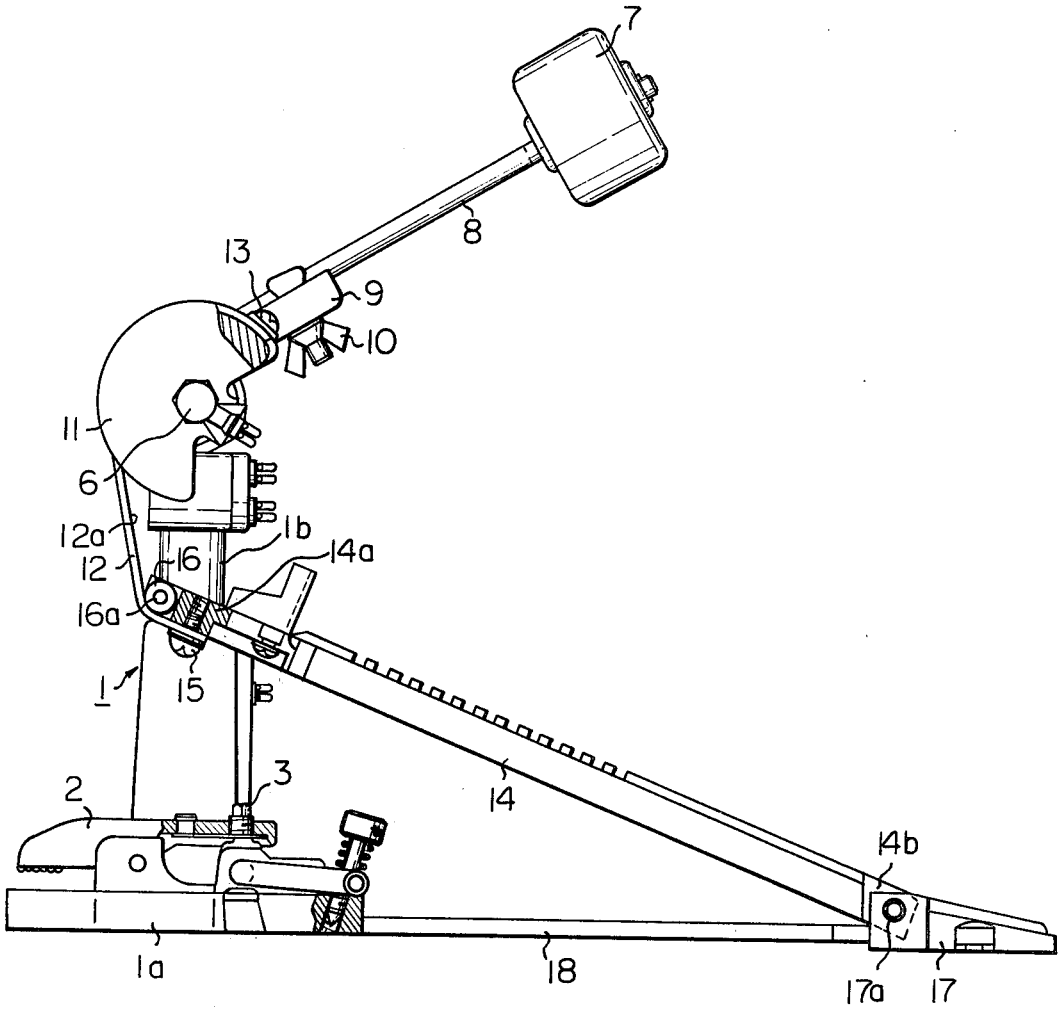
Fig. 1B PRIOR ART
FIG. 1B is a partly sectional side view of the foot pedal assembly shown in FIG. 1.

One typical example of the conventional foot pedal assembly for drums using a resilient belt or strap is shown in FIGS. 1A and 1B, in which a pedal frame 1 is comprised of a pedal base 1*a* to be placed on floors and a cylindrical post 1*b* arranged uprightly on the pedal base 1*a*. A hoop clamp 2 is fixed on the pedal base 1*a* via a set screw 3 and adapted for engaging with the rim of a drum for which the foot pedal assembly is to be used. A bearing block 4 is mounted atop the cylindrical post 1*b* of the pedal frame 1 and rotatably carries a main shaft 6 via a pair of radial bearings 5, the axis of the main shaft 6 extending substantially horizontally. A mounting block 9 is fixedly mounted to the main shaft 6 and carries a beater head 7 via a beater rod 8 which extends from the mounting block 9 substantially in one radial direction of the main shaft 6. The beater head 7 is adapted for beating the head of a drum to which the foot pedal assembly is coupled. As best seen in FIG. 1B, the beater rod 8 extends through a part of the mounting block 9 and the coupling point of the beater rod 8 with the mounting block 9 is releaseably fixed by a set screw 10. In other words, the distance between the axis of the main shaft 6 and the beater head 7 is adjustable as desired.

A sector shaped rocker cam 11 is fixedly mounted to the main shaft 6 in the vicinity of the mounting block 9 and is provided with a smooth peripheral surface. This rocker cam 11 is operationally connected to a foot pedal 14 via a belt or strap 12 one end of which is fixed to a point on the periphery of the rocker cam 11 by a set screw 13 while the other end of which is fixed to one end of the foot pedal 14 by a set screw 15. The belt or strap 12 is made of a resilient material such as leather, and rubber. The belt or strap 12 is provided with a smooth surface 12*a* which comes in contact with the smooth periphery of the rocker cam 11. A guide roller 16 is rotatably mounted adjacent to the above-described one end 14*a* of the foot pedal 14 via a pin 16*a* and the belt or strap 12 is entrained about the guide roller 16.

A heel plate 17 is coupled to the pedal base 1*a* of the pedal frame 1 via a connecting rod 18 being somewhat spaced therefrom and the foot pedal 14 is swingably pivoted at the other end 14*b* thereof to the heel plate 17 via a pin 17*a*, thereby the foot pedal 14 being inclined from the floor at a prescribed angle of inclination.

A bracket 20 is mounted on the cylindrical post 1*b* of the pedal frame 1 while projecting parallel to the main shaft 6 as best seen in FIG. 1A. A boss 21 is fixedly mounted to the other end of the main shaft 6 via a set screw 22. A tension spring 19 is provided, one end of which is fixed to a point on the periphery of the boss 21 and the other end of which is fixed to the bracket 20. The arrangement should be so designed that the spring 19 normally urges the main shaft 6 to turn in the clockwise direction in FIG. 1B. Due to this spring force acting on the main shaft 6, the beater head 7 is urged to move in the clockwise direction in FIG. 1B as the head is coupled in one body to the main shaft 6 via the mounting block and the foot pedal 14 is also urged to move in the clockwise direction about its pivotal support, i.e. the pin 17*a*, as the pedal is operationally coupled to the main shaft 6 via the belt or strap 12 and the rocker cam 11.

When the foot pedal 14 is stepped on, the rocker cam 11 and the main shaft 6 turn counterclockwise in FIG. 1B overcoming the above-described spring force by the spring 19 and the beater 7 beats the drum head (not shown). As the pressure on the foot pedal 14 is removed, the main shaft 6 and the rocker cam 11 turns clockwise due to the spring force by the spring 19 and the related parts all resuming their initial positions.

As briefly mentioned already, the above-described construction of the conventional foot pedal assembly for drums is accompanied by several inevitable drawbacks.

The belt or strap 12 is fixed to the periphery of the rocker cam 11 at one point only by the set screw 13 and the remaining part of the smooth surface 12*a* of the belt or strap is just in neat contact with the smooth periphery of the rocker cam 11 only. Thus, when the foot pedal 14 is stepped on, the force to be transmitted to the main shaft 6 is localized upon the set screw 13. When the foot pedal assembly resumes the initial disposition by removal of the pressure imposed on the foot pedal 14, the force to be transmitted to the foot pedal 14 is localized upon the set screw 13 also. This stress concentration tends to facilitate undesirable breakage of the set screw 13.

In addition, the above-described one point coupling of the belt or strap 12 with the rocker cam 11 via the set screw 13 hinders smooth conversion of the linear step-in force to the corresponding turning force to act on the beater head 7. This raises a serious problem especially when the foot pedal 14 is quickly stepped in in succession. In other words, movement of the beater head 7 cannot fairly follow the furious foot action applied to the foot pedal 14.

Further, the foot pedal assembly is in general very severely and repeatedly operated during performance of the drum and abruptly repeated stretching of the belt or strap 12 develop accelerated permanent strain thereof. With the conventional construction, there is provided no special mechanism for killing or absorbing such permanent strain of the belt or strap. Development of the strain greatly hinders the beater head 7 from fairly following the furious foot action applied to the foot pedal 14.

Figure 2:
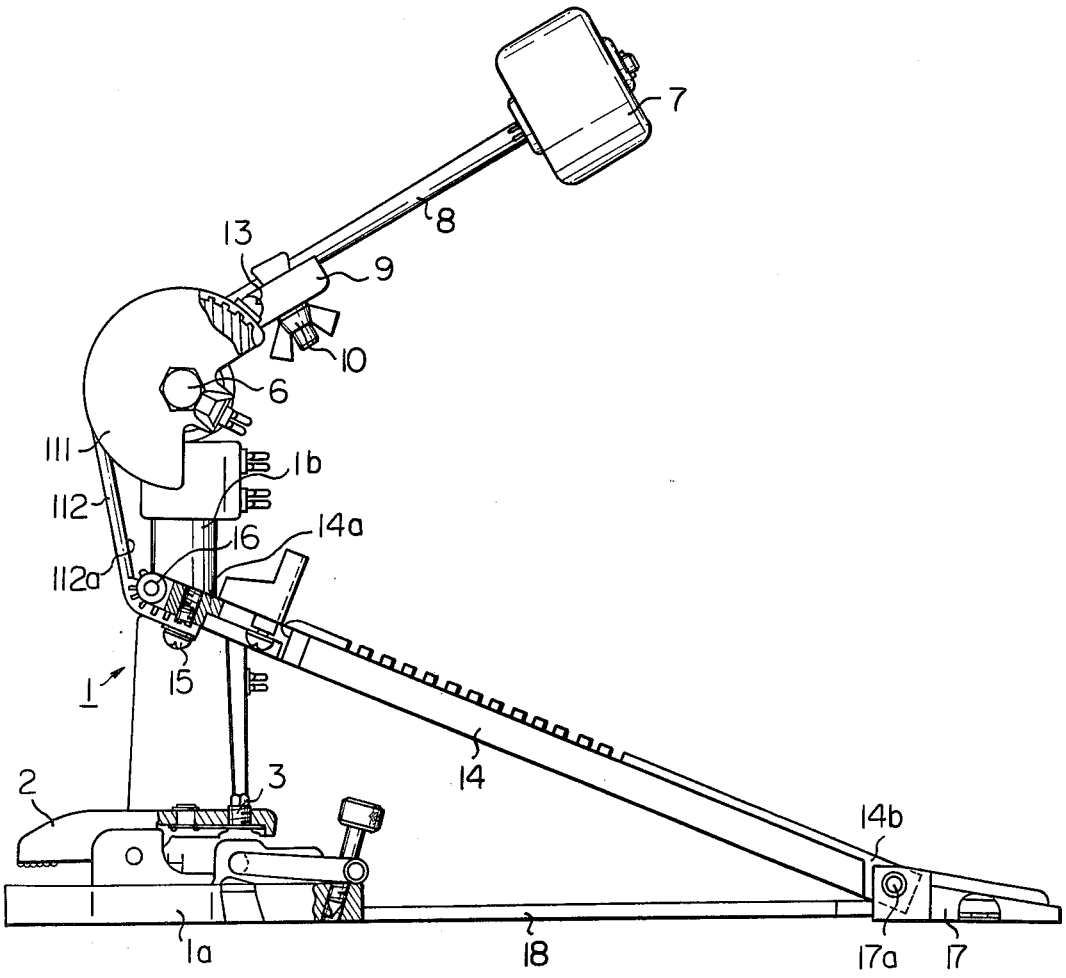
FIG. 2 is a partly sectional side view of an embodiment of the foot pedal assembly in accordance with the present invention.

One embodiment of the foot pedal assembly in accordance with the present invention is depicted in FIG. 2, in which mechanical elements substantially similar in construction to those used in the conventional foot pedal assembly are designated with common reference numerals.

Figure 3:
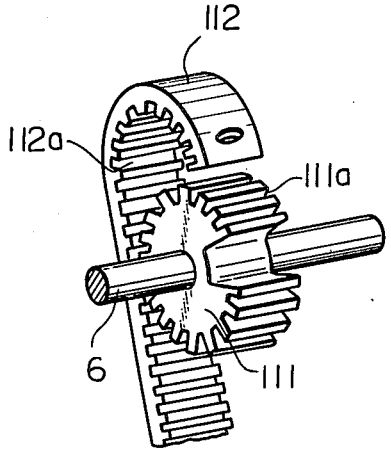
FIG. 3 is a perspective fragmentary view of the rocker cam and the belt or strap used in the foot pedal assembly shown in FIG. 2 in a disassembled state.

Like the above-described conventional foot pedal assembly, a belt or strap 112 is fixed at one end thereof to a point on the end periphery of a rocker cam 111 by the set screw 13 and at the other end thereof to the one end 14*a* of the foot pedal 14 by the set screw 15. However, in accordance with the present invention, the periphery of the rocker cam 111 is provided with indentations 111*a* running in the thickness direction of the rocker cam 111, i.e. in the axial directions of the main shaft 6 on which the rocker cam 111 is fixedly mounted. These indentations define raised teeth between them. In accordance with this, the belt or strap 112 is provided on the side thereof to be entrained about the rocker cam 111 with indentations 112*a* running in the width direction thereof as shown in FIG. 3. The dimensions of the indentations 111*a* and 112*a* should be so designed that, when the belt or strap 112 is entrained about the rocker cam 111, the teeth defined by the indentations 111*a* and the belt indentations 112*a* should mesh with each other very snugly.

It is sufficient that the indentations 112*a* should be formed in the portion of the belt or strap 112 only which is entrained about the rocker cam 111 when the beater head 7 beats the drum head. However, for further stabilized movement of the belt or strap 112, the indentations 112*a* should preferably be formed substantially over the entire length of the belt or strap 112 as is the case with the illustrated embodiment. In this case, the guide roller 16 may preferably be provided with peripheral indentations snugly meshable with the indentations 112*a* on the belt or strap 112.

The belt or strap 112 should preferably be made of a resillient material highly durable against abrasion. It is also required for the belt or strap 112 to have a high tensile strength durable against repeated abrupt stretching.

Figure 4A:
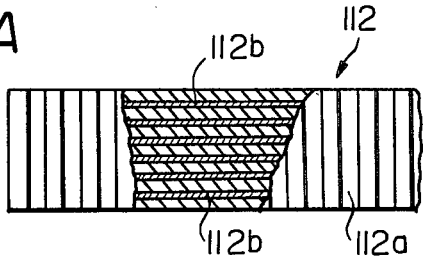
FIGS. 4A and 4B are partly sectional top and side views of an embodiment of the belt or strap advantageously usable for the foot pedal assembly shown in FIG. 2.
Figure 4B:
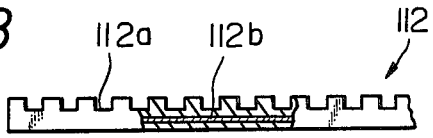

One embodiment of a belt or strap 112 excellently satisfying such requirements is illustrated in FIGS. 4A and 4B, in which the belt or strap 112 is made of a plastic resin such as polyurethane and steel wires 112*b* are embedded in the belt or strap 112 without being exposed at the indented portion 112*a* while running in the longitudinal direction of the belt or strap 112.

Figure 5:
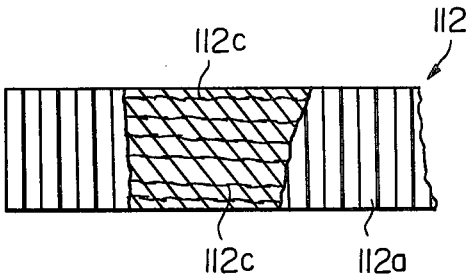
FIG. 5 is a partly sectional top view of a variant of the belt or strap shown in FIGS. 4A and 4B.

A variant of the steel-reinforced resin belt or strap is shown in FIG. 5, in which the belt or strap 112 is made of rubber and glass fibers 112*c* are embedded in the belt or strap 112. The glass fibers 112*c* are oriented in the longitudinal direction of the belt or strap 112 and are substantially continuous in that direction.

In accordance with the present invention, the rocker cam and the belt or strap are coupled to each other via meshing engagement afforded by the cooperating indentations. Thus, when the step-on force is to be transmitted to the beater head, not only the set screw 13 for fixing the belt or strap 112 to the rocker cam 111 but also the mutually meshing teeth of the indentations 111*a* and the indentations 112*a* participate in the transmission of force. This is also the case with transmission of the force to the foot pedal when pressure on the latter is removed. Thus the force is distributed over the periphery of the rocker cam 111 in meshing engagement with the belt or strap 112 and the stress concentration inherent to the conventional one point flexing can be successfully avoided.

In addition, the permanent strain of the belt or strap inevitably developed after long use of the foot pedal assembly can be well alleviated by a number of meshing engagements of the teeth and the indentations distributed over the periphery of the rocker cam. Assuming that the permanent strain of a belt or strap after a predetermined period of use amounts to $\frac{1}{2}$ inches and ten meshing engagements of indentations are distributed over the periphery of the rocker cam, only 1/20 inches of permanent strain is allotted to each tooth-indentation meshing engagement and the allotted fragments of the permanent strain cannot be cumulated due to the meshing construction of the rocker cam with the belt or strap. This distribution of the inevitable permanent strain assures that the movement of the beater head almost fairly follows the foot action applied to the foot pedal even after long use of the foot pedal assembly in accordance with the present invention. Thus, fatigue of the belt or strap gives no substantial influence on the function of the foot pedal assembly in accordance with the present invention.

The above-described distribution of the force transmission over the almost entire periphery of the rocker cam assures that fragments of the force distributed along the periphery of the rocker cam produce uniform torque about the axis of the main shaft on which the rocker cam is mounted. This uniform torque facilitates conversion of the linear step-on force to the corresponding turning force to act on the beater head.

Use of the flexible belt or strap releases the foot pedal assembly in accordance with the present invention from the trouble of uncomfortable noises conventionally caused by chains or metallic bands for operationally coupling the foot pedal to the rocker cam. Relatively poor tensile strength of such a resillient belt or strap is well compensated by embedding steel wires or glass fibers in the belt or strap which run substantially continuously in the longitudinal direction of the belt or strap.

I claim:

1. A foot pedal assembly for percussion musical instruments, comprising:

a pedal frame; an axially rotatable main shaft substantially horizontally carried by said pedal frame;

a rocker cam which is fixedly mounted on and is rotatable with said main shaft and connected to a percussion head; said cam having spaced apart peripheral indentations running in the axial direction of said rocker cam and said cam indentations defining teeth between the indentations around the periphery of said cam;

a foot pedal spaced from and movable with respect to said cam;

a strap of resilient sound-deadening material longitudinally reinforced with substantially non-stretchable elements and fixedly connected at one end to the periphery of said rocker cam; said strap being connected at the other end to said foot pedal to be moved by movement of said foot pedal; said strap having transverse indentations defined on one surface thereof and running in the width direction across said belt; said strap indentations being so shaped and spaced and said foot pedal and said strap being so oriented and positioned and being movable so that said strap indentations are meshingly engageable with said teeth of said cam and the length portion of said strap which is wrapped over said cam periphery being thus meshingly engaged; said strap indentations being on at least that portion of said strap that can pass in contact with said cam as said foot pedal is operated;

further comprising a guide roller rotatably mounted to said foot pedal and about which said strap is entrained as said strap extends to the location at which it is attached to said foot pedal;

in which said guide roller is provided with peripheral indentations that define teeth on said guide roller and the teeth run in the axial direction of said guide roller and said strap is provided with said indentations which are meshingly engageable with said teeth of said guide roller; said indentations being formed on at that portion of the surface of said strap which is to be entrained about and in contact with said guide roller teeth.

* * * * *